US010900500B2

(12) United States Patent
Nalini et al.

(10) Patent No.: US 10,900,500 B2
(45) Date of Patent: Jan. 26, 2021

(54) EJECTOR FOR A REFRIGERATING MACHINE

(71) Applicant: CAREL INDUSTRIES S.P.A., Brugine (IT)

(72) Inventors: Luigi Nalini, Brugine (IT); Davide Scarabottolo, Brugine (IT); Daniele Cazzin, Brugine (IT); Filippo Ponchia, Brugine (IT)

(73) Assignee: CAREL INDUSTRIES S.P.A., Brugine (IT)

( * ) Notice: Subject to any disclaimer, the term of this patent is extended or adjusted under 35 U.S.C. 154(b) by 466 days.

(21) Appl. No.: 15/489,797

(22) Filed: Apr. 18, 2017

(65) Prior Publication Data

US 2017/0298961 A1 Oct. 19, 2017

(30) Foreign Application Priority Data

Apr. 18, 2016 (IT) ..... 102016000039706

(51) Int. Cl.

| | |
|---|---|
| ***F04F 5/52*** | (2006.01) |
| ***F25B 1/06*** | (2006.01) |
| ***F04F 5/46*** | (2006.01) |
| ***F04F 5/20*** | (2006.01) |
| ***F25B 41/00*** | (2006.01) |

(52) U.S. Cl.

CPC ..... *F04F 5/52* (2013.01); *F04F 5/20* (2013.01); *F04F 5/46* (2013.01); *F25B 1/06* (2013.01); *F25B 41/00* (2013.01); *F25B 2341/0013* (2013.01)

(58) Field of Classification Search

CPC ..... F04F 5/52; F04F 5/20; F04F 5/46; F04F 41/00; F25B 1/06; F25B 2341/0013

See application file for complete search history.

(56) References Cited

U.S. PATENT DOCUMENTS

| | | | | |
|---|---|---|---|---|
| 2005/0155374 | A1 | 7/2005 | Oshitani et al. | |
| 2005/0188719 | A1* | 9/2005 | Sugiura | F25B 41/00 62/500 |
| 2007/0090316 | A1* | 4/2007 | Nalini | F16K 31/047 251/129.11 |
| 2015/0354601 | A1* | 12/2015 | Tell | F04F 5/20 417/54 |
| 2017/0108256 | A1* | 4/2017 | Verma | F25B 41/00 |

FOREIGN PATENT DOCUMENTS

| | | | | |
|---|---|---|---|---|
| JP | 2005-233121 | A | 9/2005 | |
| WO | 2015/116480 | A1 | 8/2015 | |
| WO | WO-2015116480 | A1 * | 8/2015 | F25B 41/00 |

OTHER PUBLICATIONS

Italian Search Report dated Jan. 9, 2017 in corresponding Application No. ITUA20162684; 7 pgs.

* cited by examiner

*Primary Examiner* — Essama Omgba
*Assistant Examiner* — Christopher J Brunjes
(74) *Attorney, Agent, or Firm* — Maier & Maier, PLLC

(57) ABSTRACT

An ejector for a refrigerating machine having a main body crossed by a conduit for passage of refrigerant fluid and having a compartment which includes a seating, which is in communication with the conduit, and a mouth for inlet of refrigerant fluid; a nozzle which can be coupled with the seating and has an internal hole for passage of the refrigerant fluid, and a shutter having an end which can be coupled with the hole to close the hole.

7 Claims, 4 Drawing Sheets

EJECTOR FOR A REFRIGERATING MACHINE

The present invention relates to an ejector for a refrigerating machine.

In particular, the present invention relates to an ejector for adjustment of the flow rate of refrigerant fluid in the refrigerating circuit of a refrigerating machine.

Therefore the present invention concerns the sector of adjustable-flow ejectors for refrigerating machines.

At present, in this sector, ejectors are known provided with a main body which has an internal conduit for passage of the refrigerant fluid, which extends between an inlet opening and an outlet opening.

The conduit comprises an operating portion which is profiled so as to form a convergent-divergent conduit.

A compartment is included in the main body for a nozzle, which compartment has a seating facing into the conduit of the ejector so that when the nozzle is inserted in the seating, the nozzle is able to direct a flow of refrigerant fluid into the convergent-divergent conduit. The compartment also has a mouth for introduction of refrigerant fluid arranged so that when the nozzle engages the seating, fluid introduced through the mouth can flow through the nozzle towards the internal conduit of the main body.

For this purpose, the nozzle has a through-hole and the ejector comprises a shutter supported relative to the nozzle movably between an opening position and a closed position adjustably so as to modulate the portion of the hole that is free of the shutter and thus adjust the rate of fluid that can flow.

The construction of this traditional ejector includes the nozzle being fixed in the main body so as to form therewith a single body.

A support is included for guiding the shutter in movement with respect to the nozzle, which support is stably fixed to the inside of the nozzle so as also to form a single body with the nozzle and with the main body.

The shutter is instead connected to an activating group which is can be fixed to and removed from the main body. A problem of this traditional ejector is that both during the first mounting and in a case of maintenance, correct insertion of the shutter in its support internally of the nozzle is not easy to perform, and the eventual extraction of the nozzle from the body of the ejector is also awkward.

Further, in regard to construction, tight tolerances are required, both in shape and dimensions, in order to guarantee a correct and precise position and reliability in movement of the shutter in the nozzle.

The problem underpinning the present invention is the simplification of the structure of the ejector to make maintenance easier and safer.

The main purpose of the present invention is to provide an ejector for a refrigerating machine which provides a solution to the above-mentioned problem by obviating the perceived drawbacks of the ejector for a refrigerating machine described in the foregoing.

Further to this purpose the present invention discloses an ejector for a refrigerating machine which maintains an efficient alignment of the shutter and the nozzle over very long periods of time.

A further aim of the present invention is to provide an ejector for a refrigerating machine which requires simpler work operations that are also more economical to perform, while maintaining the precision of the ejectors of the prior art.

A further aim of the invention consists in providing an ejector that is easy to assemble and disassemble so as to guarantee an effective and durable seal of the ejector.

This task, as well as these and other aims which will emerge more fully in the following, are attained by an ejector for a refrigerating machine according to appended claim 1.

Detailed characteristics of the ejector for a refrigerating machine according to the invention are reported in the corresponding dependent claims.

Further characteristics and advantages of the invention will emerge more fully from the description of a preferred but not exclusive embodiment of an ejector for a refrigerating machine according to the invention, illustrated by way of non-limiting example in the appended table of drawings, in which.

Figure 1:
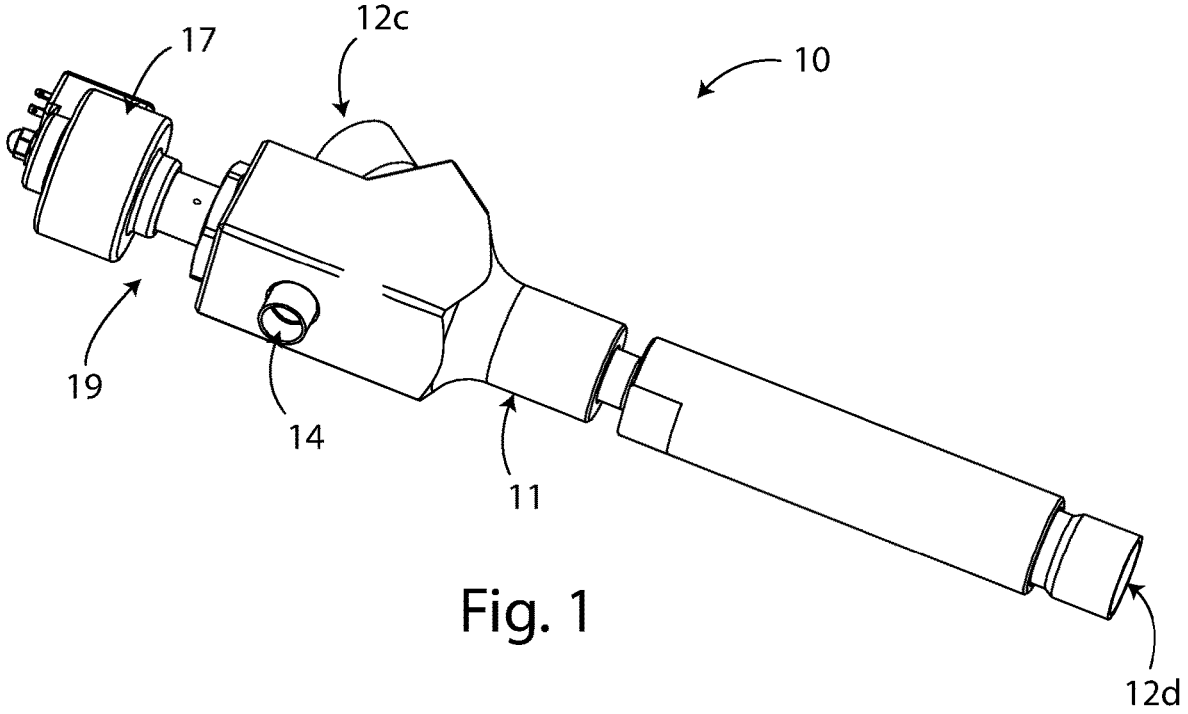
FIG. 1 illustrates an ejector according to present invention in a perspective view.
Figure 2:
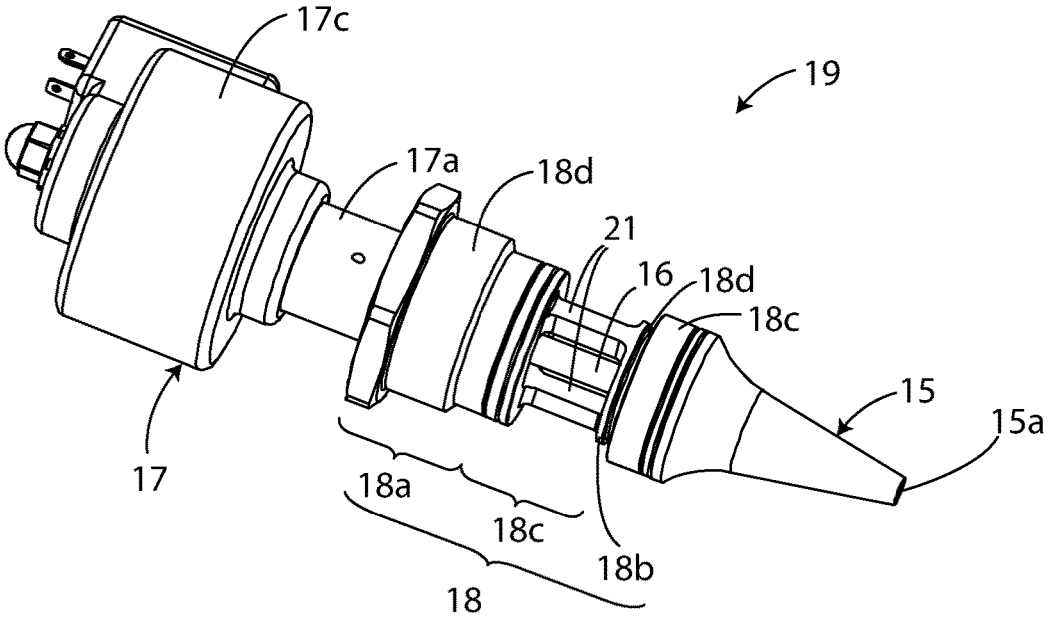
FIG. 2 illustrates a component of the ejector of FIG. 1, in a perspective view.
Figure 3:
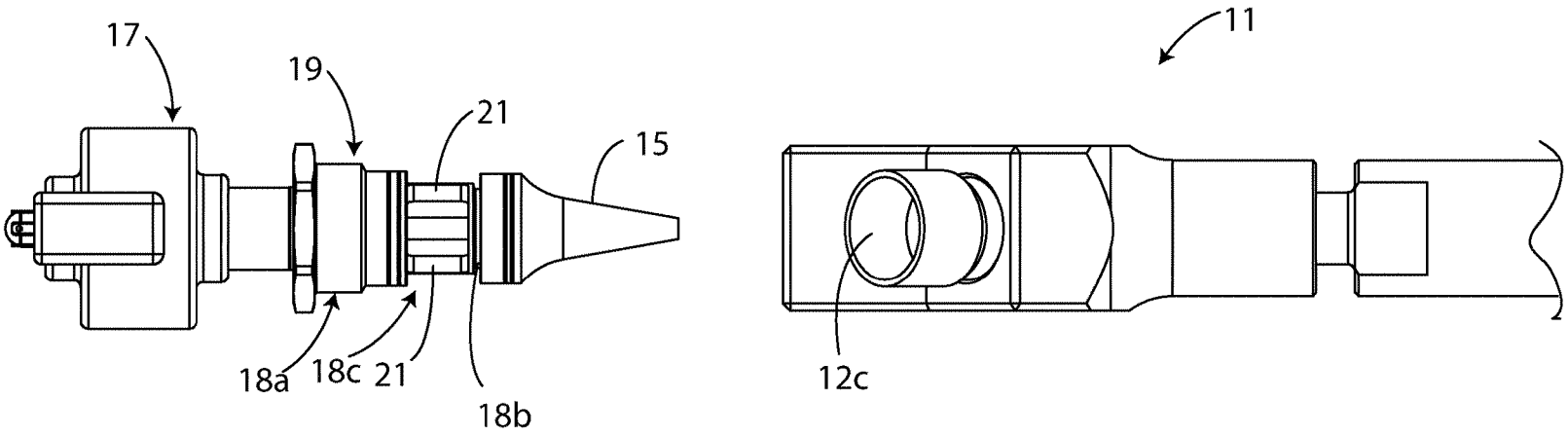
FIG. 3 is a plan view from above of the ejector of FIG. 1 with the component of FIG. 2 separated from the rest of the ejector.
Figure 4:
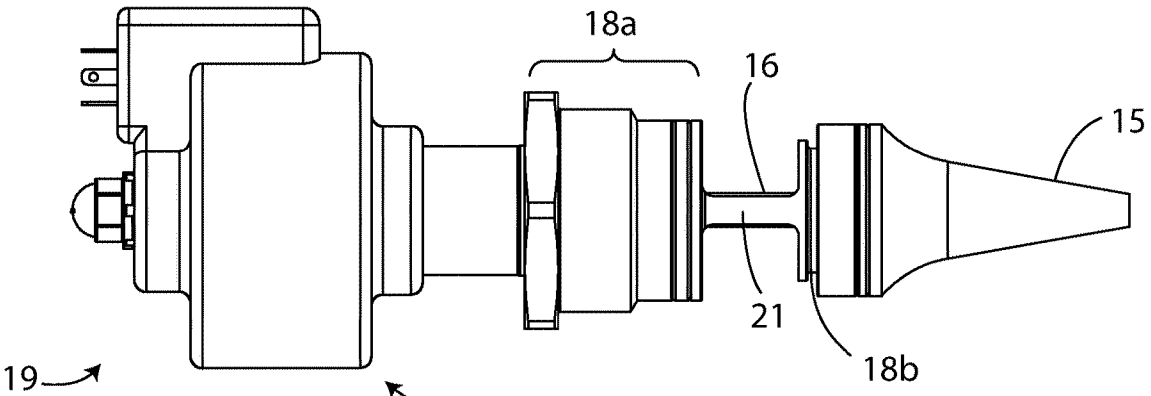
FIG. 4 is a lateral view of the component of FIG. 2.
Figure 5:
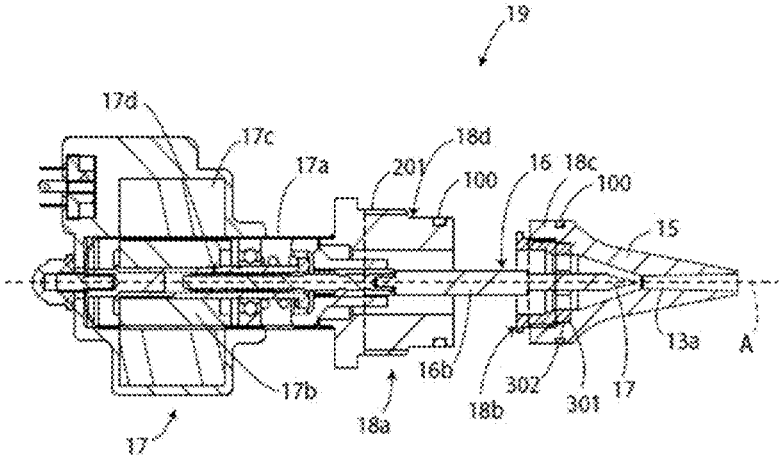
Figure 6:
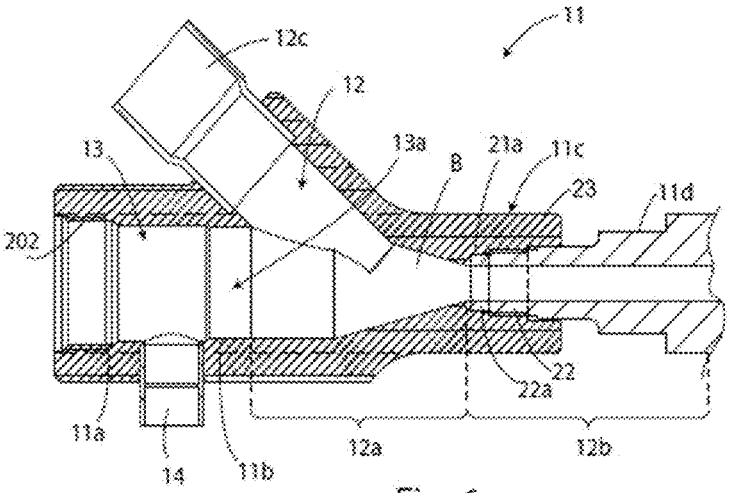
Figure 7:
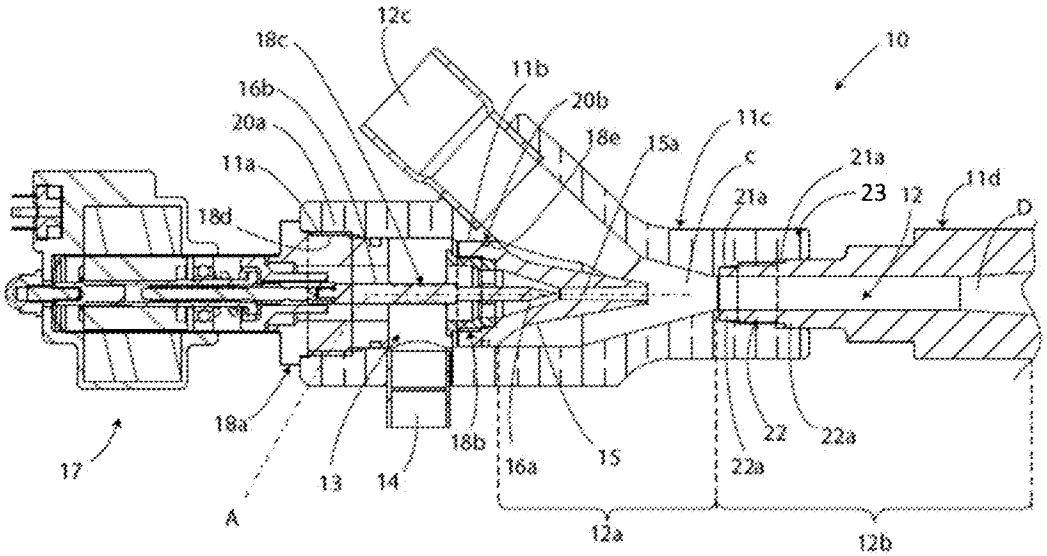

FIGS. 5 and 6 each illustrate one of the two parts of the ejector, visible in FIG. 3, sectioned according to plane V-V of FIG. 3;

FIG. 7 illustrates the parts of FIGS. 5 and 6 assembled to form the ejector of FIG. 1.

With particular reference to the cited figures, reference numeral 10 denotes in its entirety an ejector for a refrigerating machine which, in an essentially traditional way, comprises:

- a main body 11 crossed by a conduit 12 for passage of refrigerant fluid and having a compartment 13 which comprises a seating 13*a*, which is in communication with the conduit 12, and a mouth 14 for inlet of refrigerant fluid;
- a nozzle 15 which can be coupled with the seating 13*a* and having an internal hole 15*a*, preferably straight and divergent, for passage of the refrigerant fluid;
- a shutter 16 having a preferably sharp end 16*a* able to couple with the hole 15*a* so as to close the hole 15*a* gradually following insertion therein of the end 16*a;*
- an activating group 17 connectable to the shutter 16 and able to move the shutter 16 with respect to the hole 15*a* so as to obstruct the hole 15*a* adjustably for modulating the flow rate of refrigerant fluid which, in use originating from the mouth 14, is directed to the nozzle 15 so as to be introduced into the conduit 12 via the nozzle 15.

A special characteristic of the ejector 10 in the present invention is that it comprises a connector element 18 which can be fixed or is fixed to the activating group 17 and to the nozzle 15 thereby forming a cartridge organ 19 that is autonomous relative to the main body 11; the ejector 10 comprising coupling means 20*a*, 20*b* able to fix the cartridge organ 19 to the main body 11 and where the fixture can be removed and sealed.

The connector element 18, according to present invention, can be a separate part that is fixable to the activating group 17 and/or to the nozzle 15 or can be in a single piece with the activating group 17 and/or with the nozzle 15.

In practice, an ejector 10 according to the present invention consists of two components, which are easy to assemble and disassemble, which are the main body of the ejector and the cartridge organ which comprises the nozzle, the shutter thereof and the activating group of the shutter.

Owing to the fact that the nozzle forms, with the activating group, an autonomous product in fact enables a simpler mounting of the ejector 10, enabling first assembling the cartridge organ and subsequently installing it in the compartment 13 of the main body 11. Likewise, the maintenance is also easier, enabling easily separating the cartridge organ and easily verifying the conformity of the shutter, the nozzle or the activating group.

The activating group 17 preferably comprises a tubular jacket, advantageously obtained by drawing, in which the rotor of an electric stepper motor is housed, the stator of which is fixed externally of the tubular jacket.

A screw-nut screw mechanism 17*d*, preferably housed inside the tubular jacket 17*a*, connects the rotor 17*b* to the shutter 16, so that a rotation of the rotor is followed by a similar movement of the shutter 16 with respect to the hole 15*a*.

The connector element 18 advantageously comprises:

- a connecting portion 18*a* able to couple to said activating group 17 and preferably with the tubular jacket 17*a*, advantageously by means of a friction coupling;
- a support portion 18*b* able to guide the shutter 16 in relation to the nozzle 15, centred with respect to the hole 15*a;*
- a joining portion 18*c* which rigidly connects said connecting portion 18*a* to said support portion 18*b* so as to retain said connecting portion 18*a* and said support portion 18*b* in a predefined relative position, which is preferably adjustable.

The connector element 18 is advantageously configured so that the connecting portion 18*a* has a predefined position with respect to the support portion 18*b* for guaranteeing a predefined geometric tolerance of alignment and coaxial attitude between the shutter 16 and the nozzle 15.

In order to obtain a precise centring between the nozzle 15 and the shutter 16, the support portion 18*b* and the nozzle 15 comprise:

- a centring collar 301, preferably cylindrical or conical and advantageously projecting from the support portion 18*b;*
- a female seating 302, for fitting the centring collar 301, preferably defined in the nozzle 15, for defining a coaxial constraint between the shutter 16, when it is supported by the support portion 18*b*, and the hole 15*a* of the nozzle 15.

The support portion 18*b* is advantageously discoidal with through-openings and a central seating which can be engaged by the shutter 16 so as to guide it with respect to the hole 15*a*.

The support portion 18*b* can constructively be in a single piece with the joining portion 18*c* or can be fixable thereto and/or to the nozzle 15 by means of a threaded coupling.

The connector element 18 is preferably configured so as to have a free passage which is open towards the mouth 14 and towards the hole 15*a* and can be crossed by refrigerant fluid originating from the mouth 14 and directed to the hole 15*a* of the nozzle (15).

The activating group 17 is configured for moving the shutter 16 along an operating direction A along which the hole 15*a* of said nozzle 15 extends.

In a particularly efficient embodiment, the joining portion 18*c* comprises at least a bracket 21 which extends along the operating direction A, from the connecting portion 18*a* to the support portion 18*b*.

In the embodiment illustrated in the appended drawings, which has been demonstrated to be particularly functionally effective, the joining portion advantageously comprises two brackets 21, which are straight and positioned on opposite sides with respect to the stem 16*b* of the shutter 16.

In order not to interfere with the flow of refrigerant fluid coming from the mouth 14 and directed to the hole 15*a* of the nozzle 15, the brackets 21 are advantageously located laterally to a central axis of the mouth 14, when the cartridge organ 19 is joined to the main body 11.

The coupling means 20*a*, 20*b* advantageously comprise:

- first coupling means 20*a* configured for sealing and coupling the nozzle 15 to the seating 13*a;*
- second coupling means 20*b* configured for sealing and coupling the connecting portion 18*a* to the main body 11 so that the mouth 14, in use, is in a position, along the operating direction A, which is intermediate between the connecting portion 18*a* and the nozzle 15.

Further, the coupling means 20*a*, 20*b* preferably comprise centring parts provided on the main body 11 and on the cartridge organ 19 which are reciprocally combined and are configured so that when the cartridge organ 19 is assembled with the main body 11, the reciprocal position thereof is defined with a predefined tolerance both of form and of position and in general geometric.

In the embodiment illustrated in the accompanying figures of the drawings, the centring parts are advantageously made by:

- internal walls 11*a* and 11*b* of the main body 11, preferably cylindrical and coaxial to the operating direction A, and
- external walls 18*d* and 18*e* respectively of the connecting portion 18*a* and of the nozzle 15.

The external walls 18*d* and 18*e* are complementary to the internal walls 11*a* and 11*b* so as to define a centring constraint for the cartridge organ 19 with respect to the body of the ejector.

Further, seals are preferably included, preferably 0-rings 100 interposed between the internal walls 11*a* and 11*b* and the external walls 18*d* and 18*e*, so as to guarantee the seal of the coupling of the cartridge organ 19 with the main body 11.

The external wall 18*d* is preferably a part of the connecting portion 18*a* of the connector element 18 and is provided with a complementary threading 201 to a threading 202 made on the corresponding internal wall 11*a* of the main body 11, so as to be able to couple the cartridge organ thereto by screwing.

The threadings 201 and 202 are advantageously configured so that when the cartridge organ 19 is coupled to the main body 11 by screwing according to a predefined locking torque, the brackets 21 are lateral to the central axis of the mouth 14 and preferably lie on a perpendicular plane to the central axis so as to minimise the fluid-dynamic losses due to the passage of the refrigerant fluid from the mouth 14 to the nozzle 15.

In an embodiment such as the one illustrated in the appended figures, which is simple to produce, the main body 11 advantageously comprises:

- a first component 11*c* in which said compartment 13 is defined and a first part 12*a* of said conduit 12, which comprises an inlet opening 12*c* for the refrigerant fluid and preferably a convergent section B;
- a second component 11*d* with a sealed coupling to said first component 11*c* in which a second part 12*b* of the conduit 12 is defined, and where a second part 12*b* comprises an outlet opening 12*d* for the refrigerant fluid and preferably a divergent section C.

In greater detail, one of the components 11*c* and 11*d* preferably has a female connector 23 which can be coupled to a male connector 22 which is a part of the other of the components 11*c* and 11*d*.

The connectors 23, 22 are configured so that, when coupled, the first part 12*a* and the second part 12*b* of said conduit 12 are aligned so as to respect a predefined geometric tolerance.

The connectors 23 and 22 are cylindrical so as to define a centring constraint between the components 11*c* and 11*d* and are provided with threadings so as to be coupled to one another.

The connectors 23 and 22 are advantageously fixed monolithically to one another, for example by brazing and/or by friction coupling.

The conduit 12 comprises an operating section which consists in the second part 12*b* of the conduit 12 and a section of the first part 12*a* of said conduit 12, which extends from the seating 13*a* up to the second part 12*b*. This operating section extends from the seating 13*a* to the outlet opening 12*d* along a straight geometric axis which, when the ejector 10 is assembled, coincides with the operating direction A.

The male connector 22 is preferably provided with a cylindrical collar 22*a* coaxial to said geometric axis and the female connector 23 is provided with a cylindrical opening 21*a* able to receive as an insert the cylindrical collar 22*a* and coaxial with the geometric axis for defining a coaxial constraint between the portions of the operating section of the conduit 12 respectively defined in the first 11*c* and the second component 11*d*.

Owing to the specification that the main body 11 is made up of components 11*c* and 11*d*, it is of simpler embodiment as each component can easily be made by lathing a piece of brass for example and then fixed to the other component, for example by brazing and/or friction coupling.

The invention as it is conceived is susceptible to numerous modifications and variants, all falling within the scope of protection of the appended claims.

Further, all the details can be replaced by other technically-equivalent elements.

It has been demonstrated how an ejector according to the present invention attains the task and the aims as cited in the foregoing.

In practice, the materials used, as well as the contingent forms and dimensions, can be varied according to the contingent requirements and the state of the art.

Where the constructional characteristics and the technical characteristics mentioned in the following claims are followed by signs or reference numerals, the signs or reference numerals have been used only with the aim of increasing the intelligibility of the claims themselves and, consequently, they do not constitute in any way a limitation to the interpretation of each identified element, purely by way of example, by the signs or reference numerals.

The invention claimed is:

1. An ejector for a refrigerating machine, comprising:

a main body crossed by a conduit for passage of refrigerant fluid and having a compartment which comprises a seating, which is in communication with said conduit, and wherein the main body comprises a mouth for inlet of refrigerant fluid;

a nozzle coupled to the said seating and having an internal hole, for passage of the refrigerant fluid;

a shutter having an end able to couple with said hole to close said hole;

an activating group connectable to said shutter and able to move the shutter with respect to the hole of said nozzle to obstruct said hole with said shutter, adjustably for modulating the flow rate of refrigerant fluid which, in use originating from said mouth, is introduced into the conduit of said main body via said nozzle;

wherein the ejector comprises a connector element which can be fixed or is fixed to said activating group and to said nozzle to form therewith a cartridge organ that is autonomous relative to said main body;

wherein the nozzle is fixed to the activating group through the connector element, forming the cartridge organ as an autonomous product, and wherein the cartridge organ is assembled and removably coupled in the compartment of the main body;

wherein said connector element comprises a connecting portion able to couple to said activating group; a support portion able to guide said shutter in relation to said nozzle, centered with respect to said hole; and a joining portion which rigidly connects said connecting portion to said support portion to retain said connecting portion and said support portion in a predefined relative position;

wherein said connector element is configured so as to have a free passage which is open towards said mouth and towards said hole and can be crossed by refrigerant fluid originating from said mouth and directed to the hole of said nozzle; and wherein the joining portion comprises two brackets, which are straight and positioned on opposite sides with respect to a stem of said shutter, said brackets being positioned laterally to a central axis of said mouth, when said cartridge organ is joined to said main body, for minimizing fluid-dynamic losses of the refrigerant fluid flowing, in use, from said mouth towards said nozzle.

2. The ejector according to claim 1, wherein said activating group is configured for moving said shutter along an operating direction along which the hole of said nozzle extends.

3. The ejector according to claim 1, further comprising a first and a second coupling means, wherein said first coupling means is configured for sealing and coupling said nozzle to said seating; and the second coupling means is configured for sealing and coupling the connecting portion of the connector element to said main body so that said mouth, in use, is in a position, along said operating direction, which is intermediate between said connecting portion and said nozzle.

4. The ejector according to claim 3, wherein said first and second coupling means comprise centering parts provided on said main body and on said cartridge organ which are reciprocally complementary and are configured so that when said cartridge organ is assembled with said main body the reciprocal position thereof is defined with a predefined tolerance.

5. The ejector according to claim 1, wherein said main body comprises: a first component in which said compartment is defined and a first part of said conduit, which comprises an inlet opening for the refrigerant fluid;

a second component with a sealed coupling to said first component in which a second part of said conduit is defined, and where the second part comprises an outlet opening for the refrigerant fluid.

6. The ejector according to claim 5, wherein one of said components has a female connector which can be coupled to a male connector which is a part of the other of said components; said male and female connectors being configured so that when coupled the first part and the second part of said conduit are aligned to respect a predefined geometric tolerance.

7. The ejector according to claim 6, wherein said conduit comprises an operating section which is in the second part of said conduit and a section of the first part of said conduit, which extends from the seating for said nozzle up to the second part of said conduit; said operating section extends from said seating to said outlet opening along a straight geometric axis; said male connector being provided with a cylindrical collar coaxial to said geometric axis and said female connector being provided with a cylindrical opening able to receive as an insert the said cylindrical collar and coaxial with said geometric axis for defining a coaxial constraint between the portions of the operating section of said conduit respectively defined in said first and said second component.

* * * * *